United States Patent [19]

Tanaka et al.

[11] Patent Number: 4,821,257

[45] Date of Patent: Apr. 11, 1989

[54] ELECTRICITY SUPPLY STRUCTURE FOR A PIEZOELECTRIC VIBRATOR

[75] Inventors: Nobuhiro Tanaka; Takumi Matsuda, both of Tokyo, Japan

[73] Assignee: Seikosha Co., Ltd., Tokyo, Japan

[21] Appl. No.: 174,836

[22] Filed: Mar. 29, 1988

[30] Foreign Application Priority Data

Mar. 30, 1987 [JP] Japan ..... 62-47215[U]
Mar. 30, 1987 [JP] Japan ..... 62-47216[U]

[51] Int. Cl.[4] ..... G04C 21/16
[52] U.S. Cl. ..... 368/255
[58] Field of Search ..... 368/88, 203, 204, 255

[56] References Cited

U.S. PATENT DOCUMENTS 3,780,522 12/1973 Yoshida ..... 368/255
4,068,461 1/1978 Fossett et al. ..... 368/255
4,496,247 1/1985 Kunada ..... 368/255

FOREIGN PATENT DOCUMENTS 58-22987 2/1983 Japan ..... 368/255

*Primary Examiner*—Vit W. Miska
*Attorney, Agent, or Firm*—Bruce L. Adams; Van C. Wilks

[57] ABSTRACT

An electricity supply structure for a piezoelectric vibrator includes a circuit board and a coil spring having one end positioned in contact with the circuit board and the other end with a portion extending toward the center of the spring and a rising contact portion which stands on the extending portion at a central portion of the coil spring. A piezoelectric vibrator is in contact with the free end of the rising contact portion of the coil spring and a positioning rod for positioning the coil spring is formed integrally with the base plate and is provided at the distal portion thereof with a groove in which the extending portion is insertable to prevent radial movement of the rising contact portion relative to the piezoelectric vibrator.

5 Claims, 3 Drawing Sheets

ELECTRICITY SUPPLY STRUCTURE FOR A PIEZOELECTRIC VIBRATOR

BACKGROUND OF THE INVENTION

This utility model relates to an electricity supply structure for a piezoelectric vibrator for use in an alarm buzzer of a timepiece or the like.

A conventional electricity supply structure for a piezoelectric vibrator for use in a timepiece buzzer is known in which one end of a coil spring is positioned in contact with a predetermined circuit pattern on a circuit board, while another end of the coil spring is positioned in contact with the outer periphery of the piezoelectric element of the piezoelectric vibrator. The coil spring has opposite annular end surfaces which are formed flat or coplanar.

SUMMARY OF THE INVENTION

As is well known, in order not to prevent the vibration of the vibrator in buzzer and a speaker which utilize a piezoelectric vibrator, a connecting coil spring is preferably positioned in contact with the outer periphery of the piezoelectric element of the vibrator.

However, if it is intended that the coil spring with the structure described above is positioned in contact with the outer periphery of the piezoelectric element, a part of the annular coil spring whose two ends are formed flat or coplanar is inevitably disposed adjacent to a central portion of the vibrator. As a result of this, an adequate sound volume cannot be obtained. This phenomenon is especially remarkable in the case of a buzzer for a watch provided with an alarm mechanism having a small-diameter piezoelectric vibrator.

An object of the present invention is therefore to provide an electricity supply structure for a piezoelectric vibrator in which one end of the electricity supply coil spring can be positioned in contact with a portion in the vicinity of the outer periphery of the piezoelectric vibrator in a point contact manner, and in which, furthermore, an adequate sound volume can be obtained.

Another object of the present invention is to provide an electricity supply structure for a piezoelectric vibrator in which a coil spring can be easily and quickly installed.

In order to achieve the abovementioned objects, this invention comprises: a circuit board; a coil spring having a base portion which is positioed in contact with the circuit board, and in which a portion extending toward its center is provided at the front end thereof, and in which a rising contact portion which stands at a central portion of the coil spring is provided in the extending portion; a piezoelectric element to which a front end of the rising contact and portion of the coil spring is positioned in contact; means for positioning the coil spring.

BRIEF DESCRIPTION OF THE INVENTION

Referring to the accompanying drawings, an embodiment of the present utility model will now be described.

Figure 1:
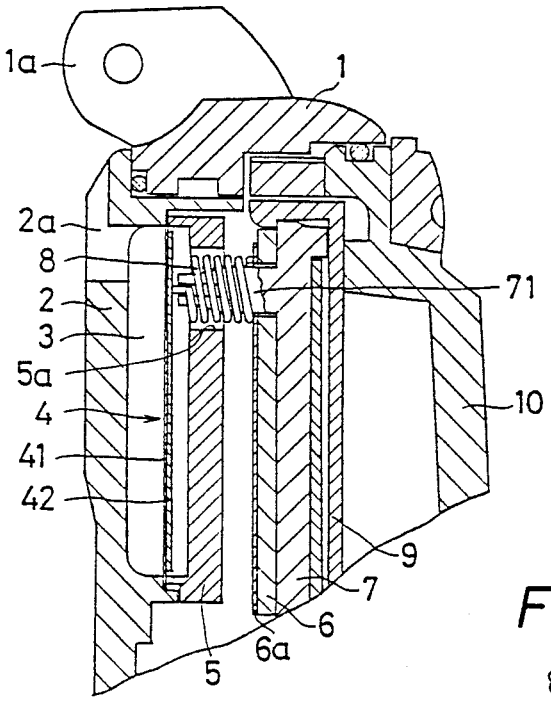
FIG. 1 is a cross-sectional view of an embodiment of the present utility model.

As shown in FIG. 1, a back cover 2 is secured to the rearside of the body 1 of a timepiece. A sound emitting hole 2*a* is bored in this back cover. In order to provide a good sound effect, it is preferable to arrange the sound emitting hole 2*a* at a position close to the band connecting portion 1*a* of the body 1 and which the user's hand does not come into close contact.

The inside of the sound emitting hole 2*a* is arranged to be a resonance chamber 3. In this resonance chamber, a piezoelectric vibrator 4 is held between the back 2 and a holder 5. The piezoelectric vibrator 4 is, as is well known, formed by way of putting a piezoelectric element 42 on a vibrating plate 41.

In the rear portion of the holder 5 (right portion of FIG. 1) is disposed a circuit board 6. A positioning rod 71 which is integrally formed with a base plate 7 penetrates through a penetrating hole (not shown) bored in this circuit board. The front end of the positioning rod 71 is, as shown in FIG. 4, disposed in a penetrating hole 5*a* in the holder 5.

Figure 3:
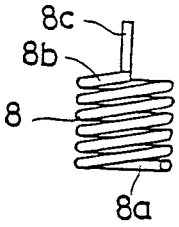
FIG. 3 is a front view of the coil spring.
Figure 2:
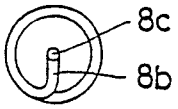
FIG. 2 is a plan view of a coil spring.

A coil spring 8 which is wound to an outer periphery of the positining rod 71 is, as shown in FIGS. 2 and 3, has a base portion 8*a* thereof which is positioned in contact with a circuit pattern 6*a* of the circuit board 6. The front end of the coil spring 8 comprises a extending portion 8*b* which extends toward a center portion and a rising contact portion 8*c* of the extending portion which stands in the center portion of the coil spring. The front surface of the rising contact portion 8*c* is, as shown in FIG. 4, positioned in contact with an outer periphery of the piezoelectric element 42 in a point contact manner.

Figure 4:
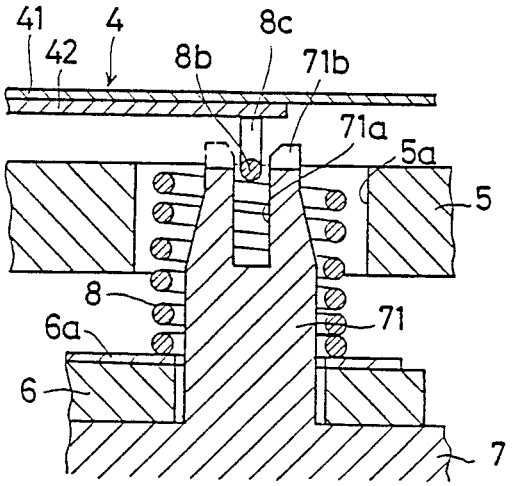
FIG. 4 is an enlarged view of an end portion of an essential portion.
Figure 5:
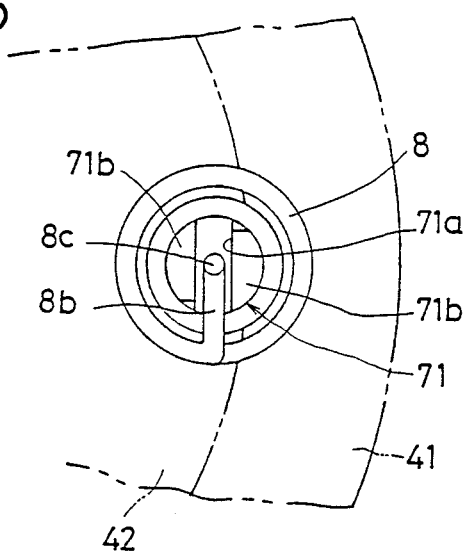
FIG. 5 is a plan view of the part shown in FIG. 4.
Figure 6:
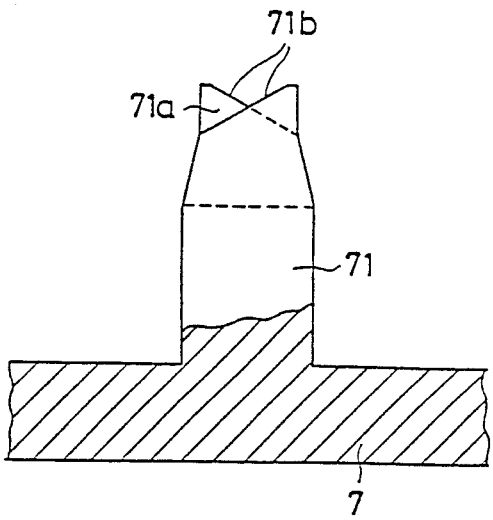
FIG. 6 is a cross-sectional view of a positioning rod.

The positioning rod 71 which serves as means for positioning the coil spring 8 is, as shown in FIGS. 4 and 5, provided with a groove 71*a* in which the extending portion 8*b* of the coil spring 8 is fitted at the front end thereof. The front surface of the positioning rod 71 is, as shown in FIGS. 5 and 6, formed by guide surfaces 71*b* and 71*b* which are slanted to each other with respect to the groove 71*a*. The groove 71*a* is, as shown in FIG. 5, arranged to be substantially disposed along an outer periphery of the piezoelectric element 42. Therefore, by way of keeping the clearance between the extending portion 8*b* and the inner surface of the groove 71*a* small, the radial movement of the coil spring 8 can be prevented, furthermore, the rising contact portion 8*c* formed in the coil spring 8 can be assuredly brought into contact with the outer periphery of the piezoelectric element 42 of the piezoelectric vibrator 4 in a point contact manner. As shown in FIG. 1, a dial 9 is secured to the base plate 7, and a front cover 10 is provided in front of the dial 9.

When the coil spring 8 is fitted from the front end of the positioning rod 71, if the extending portion 8*b* of the coil spring 8 rides over the front surface of the positioning rod, it slides along the slanted guide surfaces 71*b* and 71*b*, whereby the extending portion can be smoothly fitted in the positioning groove 71*a*. As a result, the coil spring 8 can be easily and quickly fitted.

Figure 7:
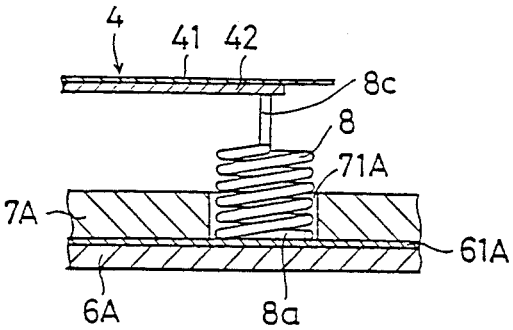
FIG. 7 is a cross-sectional view illustrating another embodiment.

FIG. 7 illustrates another embodiment according to the present invention, wherein the positional relationship between a circuit board 6A and a base plate 7A is arranged inversely to that described in the aforementioned embodiment. Namely, a positioning hole 71A which serves as positioning means is provided on a base plate 7A. The coil spring 8 is disposed in the positioning hole 71A. Reference numeral 61A indicates a circuit pattern.

[Effect of the Invention]

According to the present invention whose structure has been described above, since the front end of the rising contact portion of the coil spring can be positioned in contact with the outer periphery of the piezoelectric element in a point contact manner, an adequate sound pressure can be obtained. As a result, it can exhibit a great sound volume. Furthermore, since a guide surface is provided at the front end of of the positioning rod, a coil spring can be easily and quickly mounted.

What is claimed is:

1. An electricity supply structure for a piezoelectric vibrator comprising:

a circuit board;

a coil spring having a center, one end positioned in contact with said circuit board, and another end having a portion extending toward the center and a rising contact portion which stands on said extending portion at a central portion of said coil spring and has a free end;

a piezoelectric vibrator in contact with the free end of said rising contact portion of said coil spring;

a base plate;

a positioning rod formed integrally with the base plate for positioning said coil spring; and wherein said positioning rod has a groove at a distal portion thereof in which said extending portion is insertable to prevent radial movement of said rising contact portion relative to said piezoelectric vibrator.

2. An electricity supply structure for a piezoelectric vibrator according to claim 1, wherein said positioning rod has guide surfaces at a distal portion thereof which are slanted in opposite directions from each other with respect to said groove.

3. A piezoelectric vibrator assembly comprising:

a base plate;

a circuit board on the base plate and having a conductor thereon for supplying electricity;

a piezoelectric vibrator spaced apart from and facing the circuit board;

a coil spring for conducting electricity from the circuit board to the vibrator, the coil spring having a central axis, one end in contact with the conductor on the circuit board, and another end having an extending portion extending towards the central axis and a projecting portion projecting outwardly from the another end parallel to the central axis into contact with the vibrator; and means connected to the base plate and coactive with the extending portion of the coil spring for preventing rotation of the spring around the central axis relative to the vibrator.

4. The assembly according to claim 3, wherein the means for preventing rotation comprises a positioning rod integral with the base plate and extending through the coil spring, the rod having a distal end with a groove therein receiving the extending portion.

5. The assembly according to claim 4, wherein the distal end of the rod has guide surfaces therein which slant in opposite directions on each side of the groove.

* * * * *